US006868969B2

(12) United States Patent
Gosis et al.

(10) Patent No.: US 6,868,969 B2
(45) Date of Patent: Mar. 22, 2005

(54) PACKAGING CONTAINER FOR RANDOMLY SHAPED OBJECTS

(75) Inventors: Anatoly Gosis, Palatine, IL (US); Michael D. Loeschen, Hawthorn Woods, IL (US); Ian Brooks, Lake Barrington, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 169 days.

(21) Appl. No.: 10/289,838

(22) Filed: Nov. 7, 2002

(65) Prior Publication Data

US 2004/0089585 A1 May 13, 2004

(51) Int. Cl.[7] ..... B65D 81/02
(52) U.S. Cl. ..... 206/592; 206/395
(58) Field of Search ..... 206/525, 591, 206/592, 395, 396, 392, 391; 229/87.01, 87.02, 87.03, 87.08

(56) References Cited

U.S. PATENT DOCUMENTS

| | | | | |
|---|---|---|---|---|
| 1,069,021 A | | 7/1913 | Miller | |
| 1,758,230 A | | 5/1930 | Lange | |
| 1,871,888 A | | 8/1932 | Johnson | |
| 2,194,669 A | | 3/1940 | Mumford | |
| 2,317,884 A | | 4/1943 | Clouston | |
| 2,731,167 A | | 1/1956 | Moore | |
| 3,332,601 A | * | 7/1967 | Frank, Jr. | 206/303 |
| 3,543,994 A | | 12/1970 | Clark | |
| 3,552,633 A | | 1/1971 | Ketler | |
| 3,669,338 A | | 6/1972 | Cornell et al. | |
| 3,833,116 A | | 9/1974 | Howe | |
| 4,513,864 A | * | 4/1985 | Liebel | 206/396 |
| 4,607,750 A | | 8/1986 | Valenti | |
| 4,629,069 A | | 12/1986 | Pugh | |
| 4,662,512 A | | 5/1987 | Durand | |
| 4,871,067 A | | 10/1989 | Valenti | |
| 4,976,374 A | | 12/1990 | Macaluso | |
| 5,141,149 A | | 8/1992 | Fulton | |
| 5,513,819 A | * | 5/1996 | Orange | 242/610.2 |
| 5,657,872 A | | 8/1997 | Leftwich et al. | |
| 6,027,017 A | | 2/2000 | Kuhn et al. | |
| 6,382,447 B1 | | 5/2002 | Loeschen | |
| 6,499,655 B1 | | 12/2002 | Moen | |

* cited by examiner

*Primary Examiner*—Shian T. Luong
(74) *Attorney, Agent, or Firm*—Mark W. Croll, Esq.; Donald J. Breh, Esq.; Welsh & Katz, Ltd.

(57) ABSTRACT

A packaging container is formed from preformed, rigid base and cover units of U-shaped cross-section. The case unit is configured so that its side walls fit within and are embraced by side walls of the cover unit when assembled as a container. The side walls of the base and cover units have a plurality of straight-cut slits in their side walls, creating a plurality of flaps and allowing both the base and cover units to enclose randomly shaped objects. A single unit packaging container is also disclosed.

14 Claims, 5 Drawing Sheets

122
104
124
18
118
28
132
136
130
108
106
126
127
16
134
110
12
B

126 OR 124
62
16

PACKAGING CONTAINER FOR RANDOMLY SHAPED OBJECTS

BACKGROUND OF THE INVENTION

The present invention is directed to a packaging container. More particularly, the present invention pertains to a packaging container with a plurality of straight-cut slits, allowing the container to be folded and formed around randomly shaped objects.

Packaging for irregularly shaped items takes many forms. One type of packaging uses a layered packing process involving corrugated pads, bubble sheet (or bubble wrap), stretch-wrap film, plastic caps, and strapping tape. Such a process can be very labor-intensive, and could fail to afford a satisfactory degree of protection because the packaging may not conform well to the odd shape of the item, which can result in shifting and damage during handling and shipping.

Another variety of packaging container resolves the above-referenced problem by providing external U-shaped channels with mitered notches in their side walls, creating a plurality of flaps. The notches have specific opening angles along the crate length, which affect the degree to which the channel can flex. This type of container can roughly conform to the external contour of an irregularly shaped item, allowing a closer fit. However, the notch angle required for a particular application generally varies with the radius of the item to be packaged. In addition, this type of packaging container covers only the external contour of an irregularly shaped item. Not only is this form of packaging container very costly, it also requires complicated tooling to achieve the required notch angles, leaves spaces in item coverage, and does not provide coverage for the internal contour of oddly shaped items.

Accordingly, there exists a need for a packaging container that can be conformed to any irregularly shaped item. Desirably, such a container is formed having a plurality of flaps that are cut without miters, and thus requires no special notching to completely cover any object to be packaged. More desirably, the entirety of the end closures for the packaging container are formed from the packaging material itself. Such a configuration allows for no gaps at its closure locations. Most desirably, the container may be prepared simply by making a plurality of straight saw-cuts in the package side walls.

BRIEF SUMMARY OF THE INVENTION

A packaging container includes a preformed, rigid base of U-shaped cross-section having a bottom wall and opposing side walls, and a preformed, rigid cover unit of U-shaped cross-section having a top wall and opposing side walls. The cover unit is configured so that the side walls of the bottom unit are fitted within and embraced by the side walls of the cover unit when the base and cover units are assembled as a container. The side walls of the base and cover units have a plurality of straight-cut slits in their side walls, creating a plurality of flaps and allowing both the base and cover units to enclose randomly shaped objects.

For purposes of the present disclosure, the package material, although defined as having a U-shaped cross-section is, in fact, formed from a material having a channel-like or squared U-shape having a flat or near-flat bottom wall. The corners may be formed having a radius of curvature (i.e., rounded) or they may be formed having relatively sharp angles. However, again, for purposes of the present disclosure, the container material is referred to as "U-shaped".

In a preferred embodiment, the plurality of slits in the side walls of the base and cover units are about equal in height to the height of the base and cover units' side walls. Preferably, the pitch of the plurality of slits in the side walls of the base unit may be different from the pitch of the plurality of slits in the side walls of the cover unit. The pitch of the plurality of slits in the side walls of the base and cover units may be completely random, and may vary from each other.

In a preferred embodiment, the base unit forms an end closure for the packaging container. The end closure is formed from a first closure panel extending from and adjacent to an end of the base unit, and a second closure panel extending from and adjacent to an end of the first closure panel. The base unit and the first closure panel are separated from one another by a first fold line. The first closure panel and the second closure panel are separated from on another by a second fold line.

The base unit side walls have straight-cut corners at a juncture with the first closure panel, and the first closure panel side walls have first straight-cut corners adjacent to the base unit. The first closure panel side walls additionally have second straight-cut corners adjacent to the second closure panel, and the second closure panel side walls have straight-cut corners adjacent to the first closure panel.

The first closure panel is configured for folding generally perpendicular to the base unit bottom wall, and the second closure panel is configured for folding generally perpendicular to the first closure panel and generally parallel to the base unit bottom wall.

Most preferably, the base unit side walls have a height about equal to a height of the first and second closure panel side walls. Most preferably, the base unit includes two end closures, each positioned at an end of the base unit.

Alternately, a packaging for an other than linearly shaped item includes a preformed, rigid unit of U-shaped cross-section having a base wall and opposing side walls. The side walls of the unit have a plurality of straight-cut slits in its walls, creating a plurality of flaps. Each flap has a base wall portion and side wall portions.

Such a unit is conformable to the other than linearly shaped item, in which the side wall portions of at least some of the flaps are interleaved with side wall portions of at least some adjacent flaps to effect conformance of the container to the other than linear shape of the item. The package can be configured such that the rigid unit has first and second ends and the first and second ends are engaged with one another.

The package can include a second rigid unit of U-shaped cross-section also having a base wall and opposing side walls, in which the side walls of the second unit also have a plurality of straight-cut slits in its walls, creating a plurality of flaps. In this configuration, each flap (of the second unit also) has a base wall portion and side wall portions.

Like the first unit, the second unit is conformable to the other than linearly shaped item. The side wall portions of at least some of the flaps of the second unit are interleaved with side wall portions of at least some adjacent flaps to effect conformance of the container to the other than linear shape of the item. The side walls of the first unit are fitted within and embraced by the side walls of the second unit when the first unit and second unit are assembled as a container.

In such a package, the first and second ends of either the first or second unit are folded to form end closures, and the units are fitted together to form the package.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
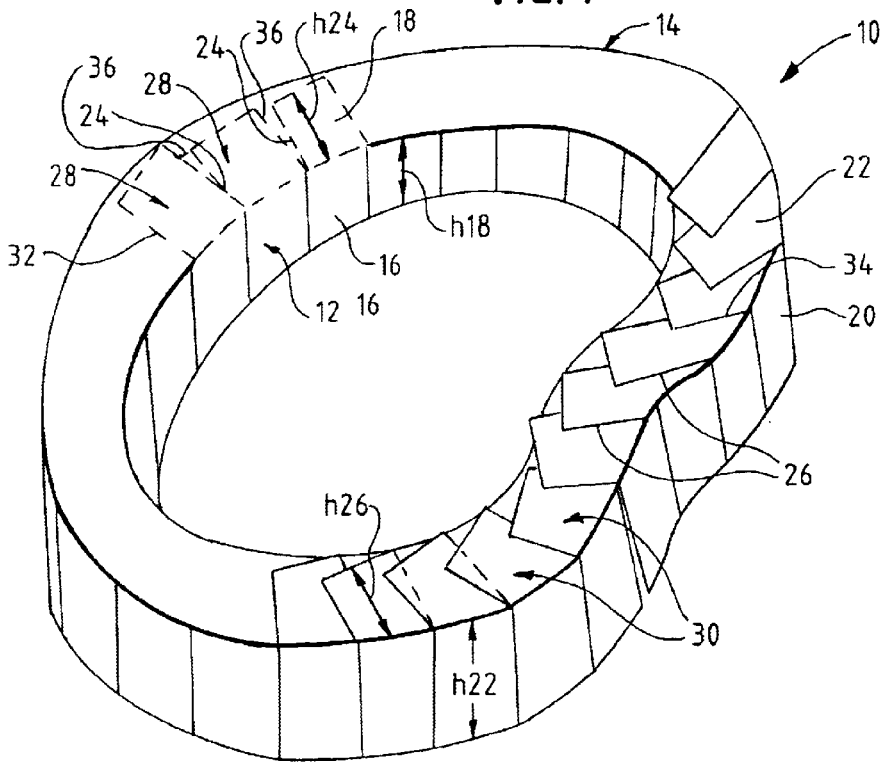
FIG. 1 is a perspective view of one embodiment of the packaging container with a plurality of straight-cut flaps constructed in accordance with the principles of the present invention, the container being shown in a fully constructed or assembled form.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular FIG. 1, there is shown a packaging container 10 embodying the principles of the present invention. The packaging container 10 includes a base unit 12 and a cover unit 14. Both the base unit 12 and the cover unit 14 are formed in an U-shaped cross-section. Preferably, the base unit 12 and the cover unit 14 are formed from laminated paperboard material. The base unit 12 includes a bottom wall 16 and side walls 18. The cover unit 14 includes a top wall 20 and side walls 22. Again, those skilled in the art will appreciate that although the container is referred to as "U-shaped", the package is actually formed from a channel-like structure having a flat or near-flat bottom wall 18.

Figure 2:
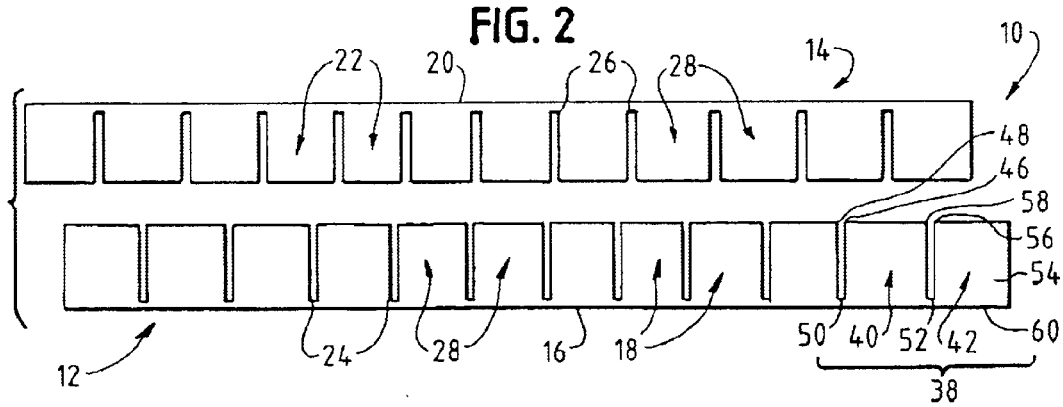
FIG. 2 is a side view illustrating an embodiment of the base and cover units of the packaging container, with the first and second closure panels of the base unit laid open, prior to folding and securing.

The side walls 18 of the base unit 12 and the side walls 22 of the cover unit 14 include a plurality of straight-cut slits 24, 26, creating a plurality of flaps 28, 30. FIG. 2 also shows the slits 24, 26 and flaps 28, 30. Preferably, the heights $h_{24}$, $h_{26}$ of the slits are about equal to the heights $h_{18}$, $h_{22}$ of the base unit 12 and cover unit 14 side walls 18, 22. The pitches 32, 34 of the slits 24, 26 may vary from each other or be entirely random.

Returning to FIG. 1, the base unit 12 and the cover unit 1 are sized so that upon assembly into a container, the side walls 18 of the base unit 12 fit within the side walls 22 of the cover unit 14. As will be recognized by those skilled in the art, the packaging container 10 can be flipped, in which case the side walls 18 of the base 12 will fit within the side walls 22 of the cover 14.

As shown in FIG. 1, assembly of the packaging container 10 is straightforward and easily carried out. First, the base unit 12 is applied to the internal contour of the item to be packaged. The base unit 12 can then be secured by a strap, glue, or tape, if desired. The straight-cut slits 24 in the side walls 18 of the base unit 12 allow the container 10 to be conformed to the shape of the item to be packaged. Application of the base unit 12 to the item to be packaged necessarily creates spaces 36 between the side wall 18 flaps 28.

Second, the cover unit 14 is applied to the external contour of the item to be packaged. The cover unit 14 conceals the spaces 36 left by the base unit 12 side wall 18 flaps 28. Each flap 26 of the cover unit 14 preferably is positioned (e.g., tucked) under a preceding flap (see, e.g. 26*a–c*), interleafing the flaps 26*a,b* and 26*b,c*, creating a reliable interlock and completely covering all surfaces of the item to be packaged. This configuration also increases the number layers of material overlying the packaged item, thus enhancing protection of the item. The cover unit 14 can be secured to the base unit 12 with a strap, glue, or tape, if desired.

Figure 3:
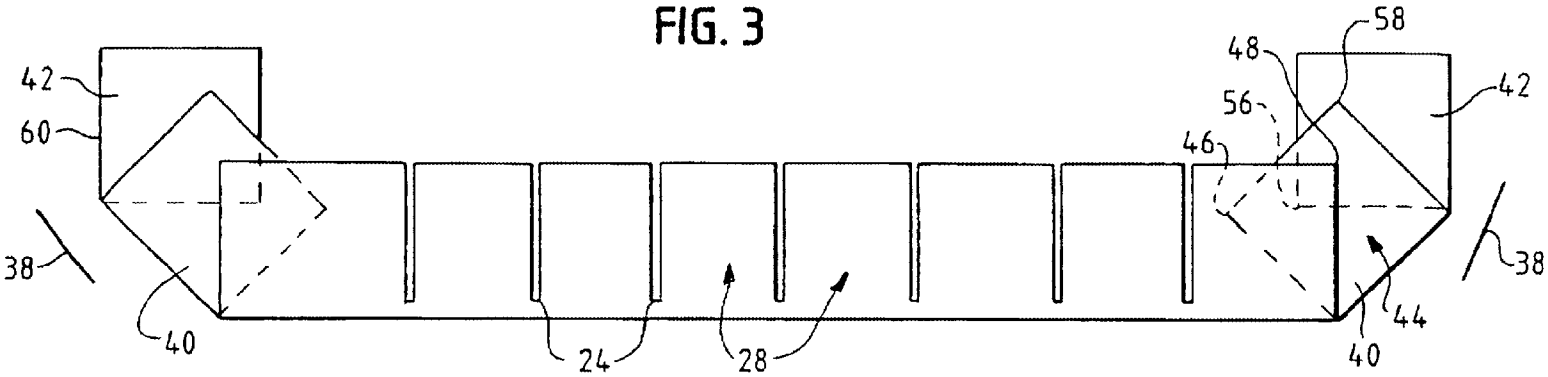
FIG. 3 illustrates the folding in-progress of the end closure of FIG. 1.
Figure 4:
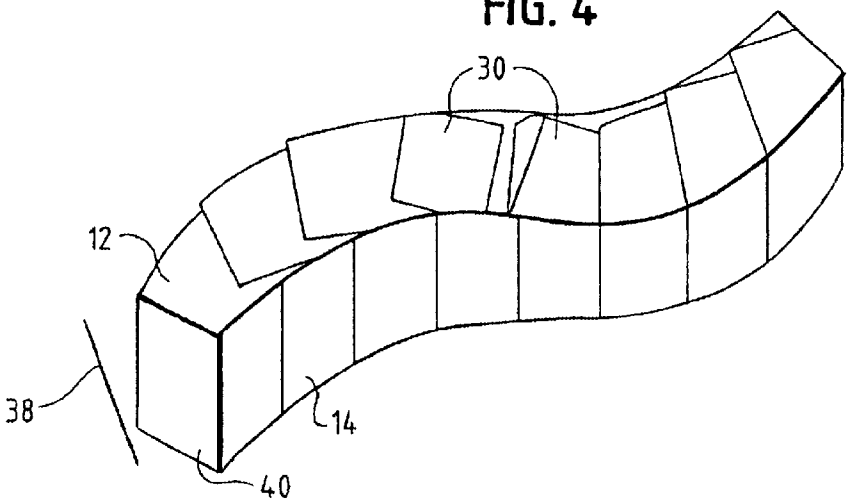
FIG. 4 illustrates an embodiment of the packaging container of FIG. 2, the container being shown in a fully constructed or assembled form.

In a preferred embodiment, the packaging container 10 includes an end-closure configuration 38, as seen in FIGS. 2–4. The closure 38 includes first and second straight-cut closure panels 40, 42 formed from an extension of the base unit 12. As will be recognized by those skilled in the art, however, the closure panels 40, 42 can be formed as part of the cover unit 14 when the cover unit 14 has a wider cross-section than that of the base unit 12. Both of these configurations are within the scope and spirit of the present invention.

The first panel 40 is formed in the base unit 12 adjacent to the location in the base unit 12 corresponding to the end of the cover unit 14. Side walls 44 of the first panel 40 have first straight-cut corners 46. The base unit side walls 18 also have straight-cut corners 48, immediately adjacent to the first panel 40 first straight-cut corners 46. A first fold line or crease 50 can be formed in the base unit 12 bottom wall 16 at the juncture of the straight-cut corners 46, 48 and the bottom wall 16 to facilitate folding.

The base unit 12 second closure panel 42 is adjacent to the first closure panel 40. The second closure panel 42 is separated from the first panel 40 by a second fold or crease line 52 formed in the bottom wall 16 of the base unit 12, parallel to the first fold line 50. Side walls 54 of the second closure panel 42 include straight-cut corners 56 at the juncture with the first closure panel 40. The side walls 44 of the first closure panel 40 include second straight-cut corners 58 adjacent to the second closure panel 42. The height $h_{18}$ of the base unit side walls 18 is about equal to the heights $h_{44}$, $h_{54}$ of the first closure panel 40 side walls 44 and the second closure panel 42 side walls 54.

Referring to FIGS. 2–4, assembling the package 10 is straightforward and easily carried out. The base unit 12 is formed around the item to be packaged, with the first and second panels 40, 42 laid out flat. The first panel is then folded upwardly, so that the first panel 40 is perpendicular to the bottom wall 16 of the base unit 12. As the first panel 40 is folded, its side walls 44 can be inserted between the base unit 12 side walls 18. The second panel 42 is then folded over, perpendicular to the first panel 40, so that the bottom wall 60 of the second panel 42 lies parallel to the bottom wall 16 of the base unit 12. As the second panel 42 is folded, its side walls 54 can be inserted between the side walls 44 of the first panel 40. The cover unit 14 is then formed over the assembled base unit 12, its ends aligned with the base unit first fold line 50, providing an essentially self-contained package.

Since the packaging container 10 can be sealed using a non-adhesive element (such as a band or wire-tie), it is readily reusable. Known packages that require sealing with an adhesive such as tape will typically lose one or more layers of paperboard laminate when removing the adhesive. The present package 10 can be sealed without an adhesive, i.e., with a band, greatly increasing the reusability of the package 10. Alternately, of course, an adhesive can be used if it is so desired.

As will be readily appreciated by those skilled in the art, the present packaging container 10 provides an extreme degree of flexibility in packaging. This flexibility extends not only to the shape of the container 10 (that is to conform to the packaged time), but in application and use of the package.

For example, the present container 10 can be used to package both continuous and discontinuous items. For purposes of the present discussion, a continuous item is one in which the ends are joined or nearly joined to one another (such as having the shape of a life preserver or an empty picture frame, in substantially any shape), and a discontinuous item is one in which the ends of the item are not joined to one another (such as having the shape of a window shade or a floor lamp, whether straight or bent/curved).

The present container can be used such that a single unit (e.g., a base unit 12 or a cover unit 14) can cover or overlie the outside, e.g., the outer periphery, only of a continuous item to be packaged. Accordingly, if the continuous item has an inner periphery, a complementary base or cover unit 12, 14, can be used to overlie the inner periphery, and the "inner" and "outer" units can be used to cover the item in a toroidal manner.

With respect to discontinuous items, a pair of units (i.e., base and cover units 12, 14) can be used to form a traditional top and bottom enclosure. In such an arrangement, it is anticipated that the end closures can be formed from either the top or bottom unit, as described above. Alternately, if the item to be packaged is not overly long, a single unit can be used to form the package. In such a single piece package, the item is placed in the unit, and the ends of the unit beyond the ends of the item are folded upward and inward (toward one another), as generally illustrated in FIG. 3, and then interlocked with one another and with the central (item containing) portion of the container.

Referring now to FIGS. 5–8, there is shown a device 104 for straight-cutting and embossing U-shaped packaging container sections 12, 14. The device 104 includes a frame 106, having an upper embossing/guide assembly 108 and lower cutting assembly 110 mounted thereto. An exemplary U-shaped unit, such as base unit 12 with vertical side walls 18 to be cut is positioned between the upper 108 and lower 110 assemblies. Preferably, the unit is supported by a bench or conveyor mechanism B. The unit 12 is centered and restricted from lateral movement by an adjustable centering arm 118, positioned outside of the cutting plane 120.

The upper assembly 108 includes a two-step air cylinder 122, tooled with dual embossing end-effectors 124, 126. A depth adjustment, such as the exemplary threaded element 128 vertically adjusts the position of the cylinder 122 to accommodate varying unit depths. The lower assembly 110 includes an air cylinder 130, includes two pairs of notching blades 132, 134 and an embossing return pad 136. Preferably, the embossing return pad 136 is made of a resilient material. In a preferred embodiment, the embossing return pad 136 is made of urethane.

Figure 5:
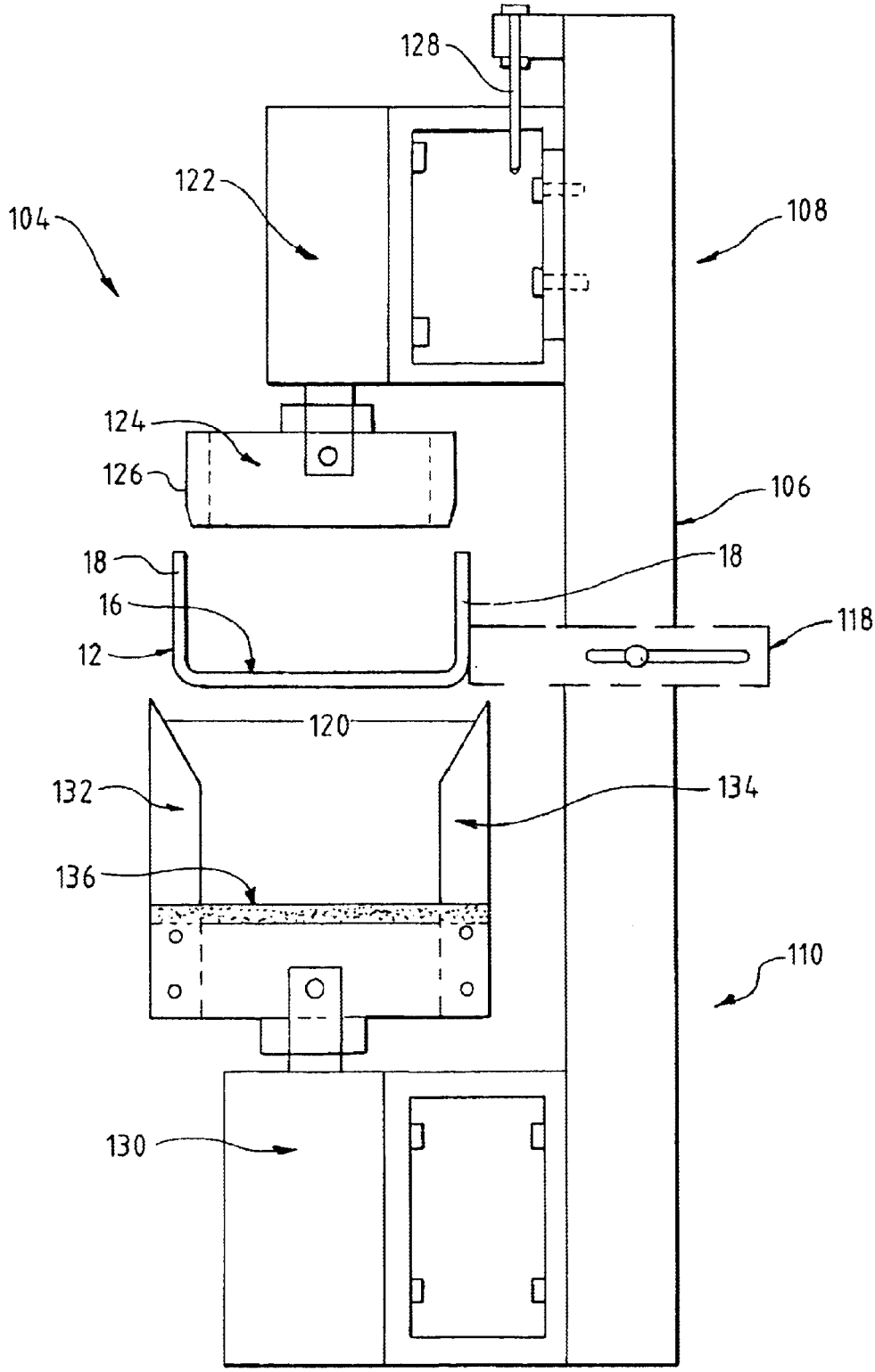
FIG. 5 is a side view of a device for straight-cutting and embossing U-shaped packaging crates, the device being shown in its at-rest position.

Referring now to FIG. 5, at the start of the cutting cycle, both the upper 108 and lower 110 assemblies are clear of the unit 12. As a first step, following manual or automatic activation, the upper air cylinder 122 extends to a first pre-programmed depth 138, causing the end-effectors 124, 126 to come into contact with an internal bottom wall 16 of the unit 12. The end-effectors 124, 126 provide support for the crate bottom wall 16 and loosely fits between the vertical side walls 18.

Figure 6:
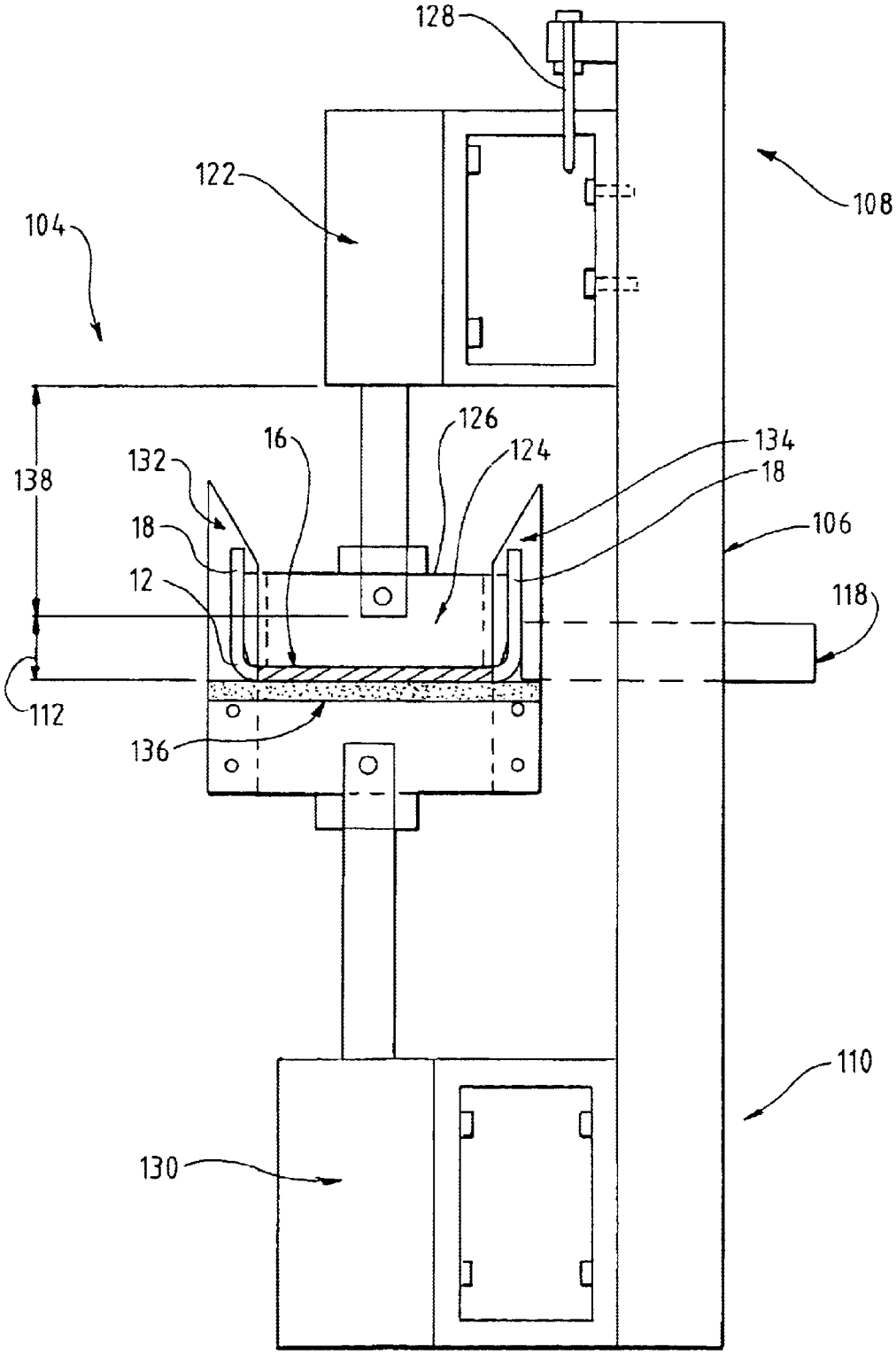
FIG. 6 illustrates the movements of the device of FIG. 5.
Figures 7, 8:
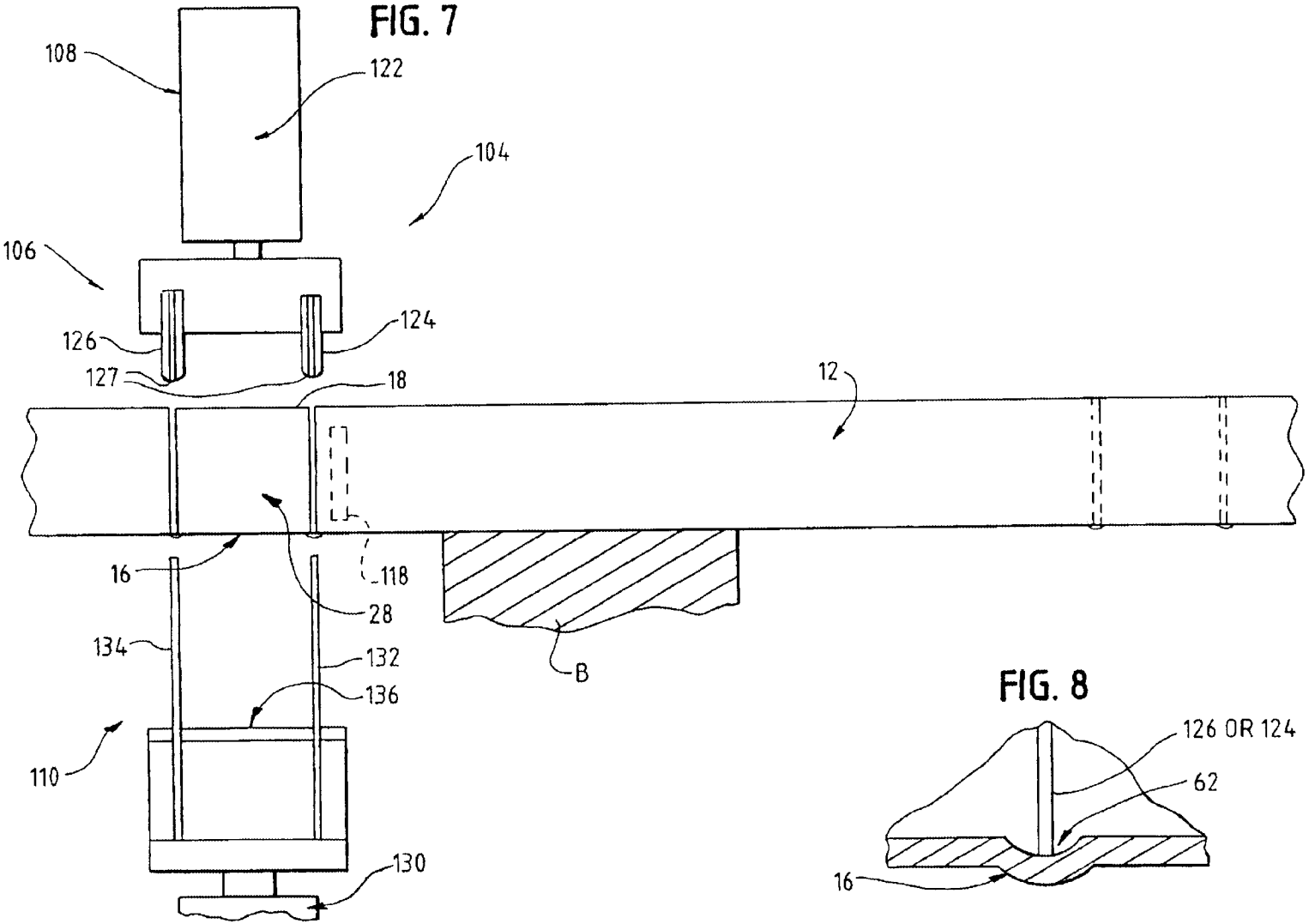
FIG. 7 is an alternate side view of the device of FIG. 5, the device being shown in its at-rest position.
FIG. 8 illustrates an indentation in a packaging crate resulting from use of the device.

Once the device 104 senses that the first step is complete, the lower air cylinder 130 extends, causing the two pairs of notching blades 132, 134 to cut completely through the crate's vertical side walls 18 leaving the crate's bottom wall 16 intact. As seen in FIG. 7, the end-effectors 124, 126 can include guides 127 formed as channels therein. The guides 127 provide a centering means to assure that the blades 132, 134 remain straight during the cutting cycle. As a third step, the two pairs of notching blades 132, 134 remain raised, causing the crate's bottom wall 16 to rest on the embossing return pad 136 (as seen in FIG. 6). Next, the upper air cylinder 122 extends to a second pre-programmed depth 142. The end-effectors 124, 126 therefore embed into the crate internal bottom wall 16, deforming the material into the embossing return pad 136. A resulting indentation 62, as see in FIG. 8, compresses the crate's bottom wall 16 along future bending lines, facilitating the formation of packaging containers. Finally, both the upper 108 and lower 110 segments return to their original positions, as in FIG. 5. As will be appreciated by those skilled in the art, the indentations form a region at which the material will more readily fold to form the container 10.

Advantageously, it has been found that the present device 104 can be used with container units 12, 14 having a wide variety of wall 18, 22 heights with minimal to no adjustment. This increases the flexibility of the packager vis-à-vis selecting a proper package based upon the articles to be packaged, rather than a package for which the device is configured or designed.

In addition, it has been found that cutting rather than sawing the material provides a "cleaner" cut with respect to the ends of the material as well as debris that may be created during the cutting operation. It has further been found that the cutting blades 132, 134, moving toward the unattached (e.g., free-) ends of the walls 18, 22 prevents collapse of the walls 18, 22, regardless of the material thickness, during the cutting operation.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A packaging container, comprising;

a preformed, rigid unit of U-shaped cross-section having a base wall and opposing side walls; and a preformed, rigid second unit of U-shaped cross-section having a base wall and opposing side walls, the second unit configured so that the side walls of the first unit are fitted within and embraced by the side walls of the second unit when the first unit and second unit are assembled as a container, the side walls of the first and second units having a plurality of straight-cut slits in their side walls, creating a plurality of flaps.

2. The packaging container in accordance with claim 1 wherein the plurality of slits in the side walls of die first and second units are equal in height to the height of the side walls of the first and second units.

3. The packaging container in accordance with claim 1 wherein the pitch of the plurality of slits in the side walls of the first unit is different from the pitch of the plurality of slits in the side walls of the second unit.

4. The packaging container in accordance with claim 1 wherein the pitch of the plurality of slits in the side walls of the first and second units varies from slit to slit.

5. The packaging container in accordance with claim 1 wherein the pitch of the plurality of slits in the side walls of the first and second units varies randomly.

6. The packaging container in accordance with claim 1 wherein each flap of the second unit is configured to fit under a preceding flap of the second unit when the first and second units are assembled as a container.

7. The packaging container in accordance with claim 1 wherein the first unit forms an end closure for the packaging container, formed from a first closure panel extending from and adjacent to an end of the first unit, and a second closure panel extending from and adjacent to an end of the first closure panel, the first unit and the first closure panel being separated from one another by a first fold line, the first closure panel and the second closure panel being separated from one another by a second fold line, the first unit side walls having straight-cut corners at a juncture with the first closure panel and the first closure panel side walls having first straight-cut corners adjacent the first unit, the first closure panel side walls having second straight-cut corners adjacent the second closure panel and the second closure panel side walls having straight-cut corners adjacent the first closure panel, the first closure panel being configured for folding generally perpendicular to the first unit base wall and the second closure panel being configured for folding generally perpendicular to the first closure panel and generally parallel to the first unit base wall.

8. The packaging container in accordance with claim 7 wherein the first unit side walls have a height that is about equal to a height of the first and second closure panel side walls.

9. The packaging container in accordance with claim 7 wherein the first unit includes two end closures, each positioned at an end of the first unit.

10. A packaging for an other than linearly shaped associated item, the container comprising:

a first preformed, rigid unit of U-shaped cross-section having a base wall and opposing side walls, the side walls of the first unit having a plurality of straight-cut slits in its walls, creating a plurality of flaps, each flap having a base wall portion and side wall portions, wherein the first unit is conformable to the other than linearly shaped item, and wherein the side wall portions of at least some of the flaps are interleafed with side wall portions of at least some adjacent flaps to effect conformance of the container to the other than linear shape of the item; and a second preformed, rigid unit of U-shaped cross-section having a base wall and opposing side walls, the side walls of the second unit having a plurality of straight-cut slits in its walls, creating a plurality of flaps each flap, having a base wall portion and side wall portions, wherein the second unit is conformable to the other than linearly shaped item, wherein the side wall portions of at least some of the flaps are interleafed with side wall portions of at least some adjacent flaps to effect conformance of the container to the other than linear shape of the item and wherein the side walls of the first unit are fitted within and embraced by the side walls of the second unit when the first unit and second unit are assembled as a container.

11. The package in accordance with claim 10 wherein the rigid unit has first and second ends and wherein the first and second ends are engaged with one another.

12. The package in accordance with claim 10 wherein the rigid unit has first and second ends and wherein at least one of the first and second ends is folded to form an end closure.

13. The package in accordance with claim 12 wherein the first and second ends are folded to form an end closure.

14. The package in accordance with claim 10 wherein the first rigid unit has first and second ends and wherein the first and second ends are folded to form first and second end closures.

* * * * *